United States Patent [19]

Finkle

[11] 4,409,589

[45] Oct. 11, 1983

[54] ADJUSTABLE ELECTRIC BELL

[75] Inventor: Louis J. Finkle, Bellflower, Calif.

[73] Assignee: Emhart Industries, Inc., Farmington, Conn.

[21] Appl. No.: 312,433

[22] Filed: Oct. 16, 1981

[51] Int. Cl.[3] ..... G08B 3/00

[52] U.S. Cl. ..... 340/396; 340/398; 340/402

[58] Field of Search ..... 340/402, 398, 396, 392

[56] References Cited

U.S. PATENT DOCUMENTS

| | | | |
|---|---|---|---|
| 4,300,128 | 11/1981 | Ishii | 340/396 |
| 4,360,800 | 11/1982 | Ishii | 340/402 |
| 4,368,458 | 1/1983 | Ishii | 340/402 |

*Primary Examiner*—Glen R. Swann, III

*Attorney, Agent, or Firm*—Gene Warzecha

[57] ABSTRACT

An electrically driven bell includes an electric motor geared to drive a rotary cam assembly having formed on a face thereof two concentric circular cams each provided with an angularly increasing ramp surface terminating in an abrupt step at the end of each revolution. A spring loaded cam follower engaged to a hammer is reciprocated by rotation of the cam to provided periodic impact against a bell. The hammer may include a return spring and the combination of a bias spring and the return spring can be utilized to produce a neutral position which according to its alignment will determine the strength of the impact. The rate of successive impacts may be adjusted by the gearing and the speed of the motor while the strength of the impact may be adjusted by the springs.

6 Claims, 5 Drawing Figures

ADJUSTABLE ELECTRIC BELL

BACKGROUND OF THE INVENTION

1. Field of the Invention

The present invention relates to sound generating devices, and more particularly to electrically driven bells which may be adjusted in intensity and frequency.

2. Description of the Prior Art

Electrically powered bells have been known in the past, most frequently taking the form of a make and break contact arrangement which is determined in strength and in frequency by the spring mass characteristics of the hammer. In applications where the intensity or the frequency are to be adjusted most of the prior art ringing devices entail elaborate mechanical manipulations which at best are merely repetitive in producing the desired result in a particular installation.

In certain situations, i.e., in installations of fire alarms or other alarm systems, the sound propagation and acoustics of the area monitored exhibit unique and varying patterns with the result that an alarm sized and resonating at one particular frequency will be inappropriate when it is installed. Typically alarms associated with smoke detectors are installed in narrow corridors of a residence which communicates with the bedrooms. Corridors of this size normally exhibit reflection and sometimes cancellation patterns which can only be accommodated by changes in frequency or amplitude. Heretofore the prior art alarm systems lacked the requisite adaptability to the varying room sizes and it is for this reason that control over frequency and amplitude is widely sought.

SUMMARY OF THE INVENTION

Accordingly, it is the general purpose and object of the present invention to provide an electrically driven alarm device which is adjustable in frequency and amplitude.

Other objects of the invention are to provide an electrically driven alarm wherein convenient adjustment of the alarm frequency can be achieved.

Yet further objects of the invention are to provide an electrical alarm wherein the rate of hammer strikes against a bell are determined by the rate of an electric motor.

Yet additional objects of the invention are to provide an electric alarm wherein the free flight of a hammer before ringing contact may be controlled.

Briefly these and other objects are accomplished within the present invention by providing an electrically operated bell assembly comprising a bell mounted on a housing, the housing including on the interior thereof two axially aligned guides each having a guide bore aligned on a common axis which is furthermore aligned along a radius of a bell. Received within the guide bores is a cylindrical hammer formed as an elongated rod, the hammer being engaged to a first and second spring disposed between these two guides. The first and second springs are generally helical in form, each abutting the adjacent surface of the corresponding guide and each futhermore being retained by way of a pin or other retaining device to the cylindrical hammer. Thus the hammer, by virtue of the spring bias, will achieve a neutral position, such neutral position being selected to deploy the hammer end at a small gap relative the bell interior surface. The other end of the hammer is engaged to a U-shaped cam follower having two legs disposed to align over two circular, concentric cam surfaces formed on a gear engaged to rotate about the hammer. The gear, in turn, is driven by a pinion on the output shaft of a electric motor and, according to the rate of the motor, the rate of cam engagement is controlled. Each cam surface itself includes a helical edge extending around a substantial portion of the periphery of a circle, the high point on the cam surfaces being cut-off at a diametrically opposed arrangement to allow the follower to drop, thus allowing the hammer to impact against the bell. The foregoing assembly of parts may be mounted on a sliding base, whereby the relative spacing of the hammer and the bell may be adjusted.

Included further in the alarm are the requisite impedence adjustments whereby the rate of the electric motor may be selected for optimal frequency of hammer strikes. Thus by selecting the motor rate and adjusting the separation between the free end of the hammer and the bell surface it is possible to control both the amplitude and the frequency of the alarm. This adjustment may be performed in situ requiring minimal tooling and effort.

DESCRIPTION OF THE SPECIFIC EMBODIMENT

Figure 1:
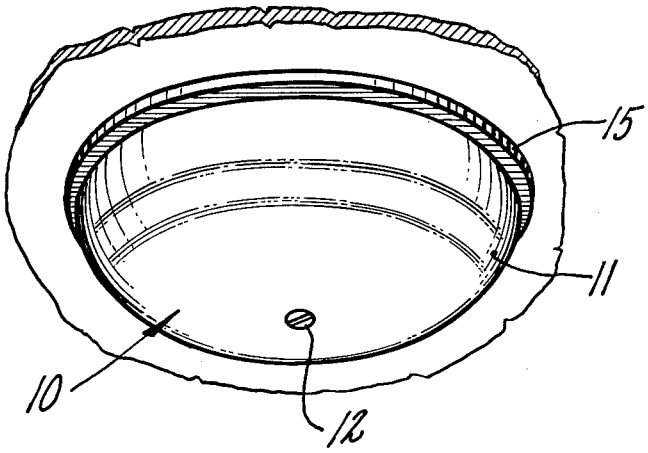
FIG. 1 is a perspective illustration of an alarm bell constructed according to the present invention.
Figure 2:
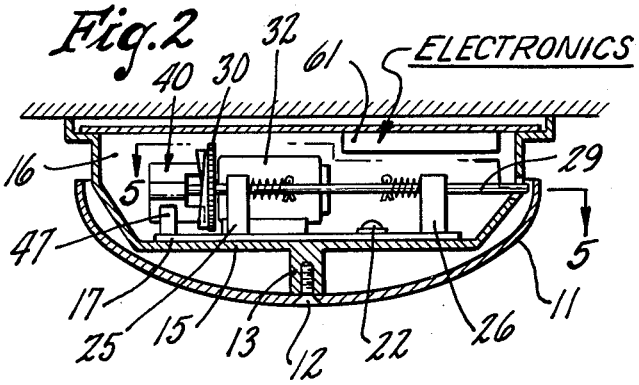
FIG. 2 is a side elevational view, in section, of FIG. 1.
Figure 5:
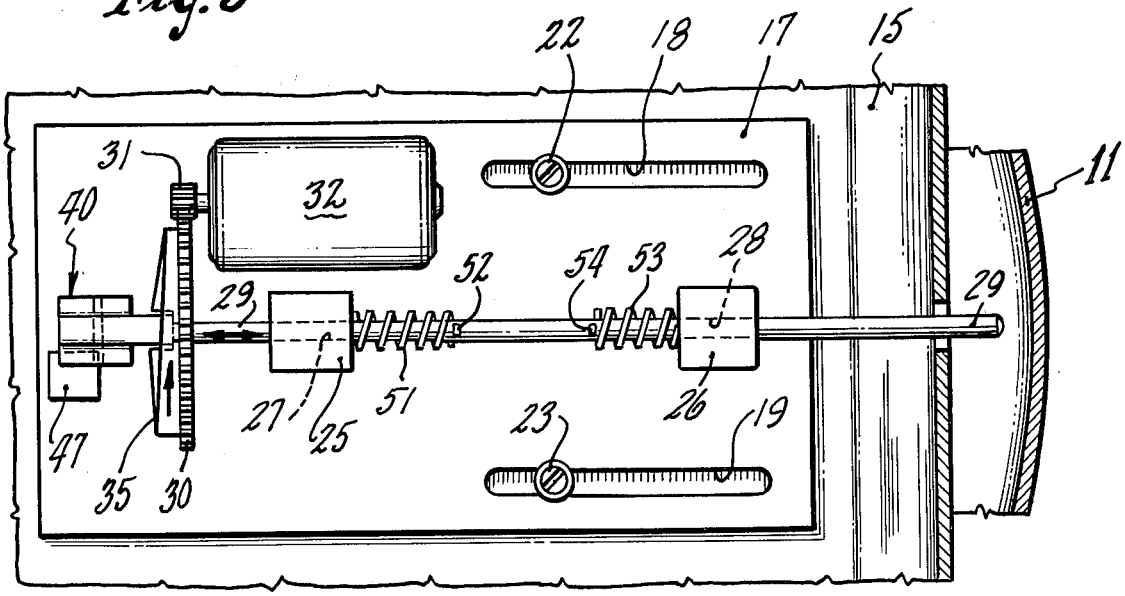
FIG. 5 is a top view of the inventive alarm device constructed according to the disclosure herein taken along the line 5—5 of FIG. 2.

As shown in FIGS. 1, 2 and 5, the inventive bell assembly, generally designated by the numeral 10, comprises a substantially hemispherical bell 11 secured at the center thereof by a screw 12 to a center post 13 extending from the exterior of the hollow base structure 15. Base structure 15 is conformed for partial receipt on the interior of the bell 11 and is provided with an interior cavity 16 in which a support plate 17 is slidably mounted.

More specifically plate 17 includes two elongate slots 18 and 19 having received therein respectively a securing screw 22 and 23. Screws 22 and 23 thus retain plate 17 relative the base structure 15 at various selected locations of transverse alignment, thus allowing for the inward or outward radial manipulation of the plate and any structure carried thereon.

Included further on the plate 17 and extending into the interior of cavity 16 are two guides 25 and 26 each provided with a corresponding bore 27 and 28, bores 27 and 28 being aligned along a common axis extending along a radial direction towards the periphery of the bell 11. Received in bores 27 and 28 and extending through the common interior thereof is a cylindrical hammer 29 extending at one end proximate the interior surface of the bell 11 and being received proximate the other end thereof in a central opening of a cam gear 30. Gear 30, in turn, is gauged to a pinion 31 at the output of an electrical motor 32 mounted on the plate 17. Thus, according to the rate of motor 32, gear 30 will be turned at the gearing ratio between the pinion 31 and the periphery thereof.

Figure 3:
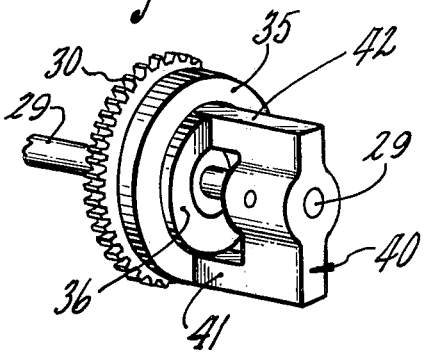
FIG. 3 is a detail view, in perspective, of a cam and follower arrangement constructed according to the invention herein.
Figure 4:
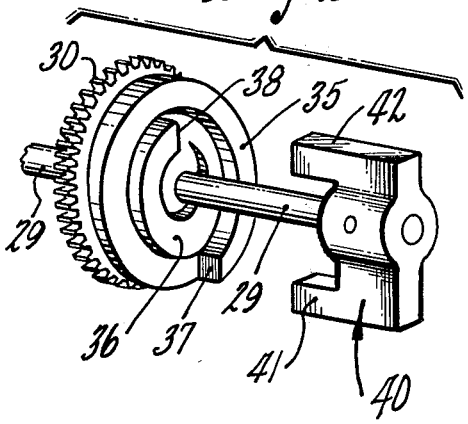
FIG. 4 is yet another illustration of a cam and follower arrangement, illustrating the follower in separated alignment.

As shown in more detail in FIGS. 3 and 4, gear 30 is provided on one face thereof with two concentric circular cam surfaces 35 and 36, surface 35 forming the radially outer surface and surface 36 forming the concentric radially inner surface. Each of the cam surfaces 35 and 36 are cut to form a helical edge extending around most of the periphery of a circle, each helical edge ending in the abrupt end cut-off 37 and 38 respectively, cut-offs 37 and 38 being substantially diametrically displaced relative each other. Thus the ramp surface of each cam originates with the surface of gear 30 and increases therefrom until the cut-off is reached. The direction of increase of each of the cam surfaces is in the same direction of rotation, and a rotation of the gear 30 will therefore rotate the cam surfaces towards the aforementioned cut-offs 37 and 38.

Hammer 29 extends, as stated above, through the center of gear 30 and engages, at the other end, a U-shaped follower 40 provided with two bent-over legs 41 and 42, leg 41 being conformed to engage surface 35 and leg 42 being conformed to engage surface 36. A stop, extending from the plate 17 and shown herein as stop 47 opposes the rotation of the follower 40 and thus directs the follower to ride on the cam surfaces 36 and 35 and thereby withdraw hammer 29 through the common interior of bores 27 and 28 and through the center of gear 30 to an alignment away from the interior surface of the bell. This withdrawal is opposed by a first centering spring 51 deployed between the interior surface of guide 25 and a cotter pin 52 extending through hammer 29.

A second centering spring opposes the hammer motion in the other direction, being shown herein as spring 53 deployed between the other opposed surface of guide 26 and yet another cotter pin 54. It is contemplated to install springs 51 and 53 between the guides and the corresponding cotter pins in compression bias, whereby an equilibrium point is achieved at which the hammer 29 is deployed. This equilibrium point is displaced by the advancement of the follower 40 on the two cam surfaces 35 and 36 until the follower legs 41 and 42 reach the respective end cuts 37 and 38. At that point the unbias is relieved by the overbiased spring 51 and by virtue of the harmonic spring mass motion the hammer 29 is thrown beyond the original bias point. By selecting the displacement of plate 17 relative the screws 22 and 23 it is possible to align the hammer at various levels of impact.

Furthermore by selecting the spring coefficient in springs 51 and 53 various dynamic features may be achieved, it being understood that in each instance the fundamental frequency of the springs and the hammer 29 is greater than the rotational rate of gear 30. Thus, in each instance as impact is made between the end of hammer 29 and the interior surface of bell 11, the rebound of the hammer will carry the follower onto the incline surfaces of cams 35 and 36.

In the embodiment disclosed herein, the rate of rotation of motor 32 is the means of adjusting the impact rate, motor 32 being provided with the necessary impedence and operating controls by electrical circuit 61 (only diagrammatically shown) by which the motor rate can be controlled. Thus, both the impact level achieved at the end of each revolution of gear 30 and the rate at which those revolutions occur can be conveniently adjusted by way of mechanical alignment and/or by conventional electrical trim.

It will be understood by those skilled in the art that many modifications and changes may be made to the embodiment disclosed herein without departing from the spirit and scope of the invention.

What is claimed is:

1. An electrically powered bell assembly comprising:

a bell;

a base structure fixed relative to said bell;

a support plate adjustably attached to said base structure for adjustable alignment relative to said bell; and a hammer assembly mounted on said plate and adapted to strike said bell, said hammer assembly including a hammer slidably mounted to impact against said bell, an electric motor, an annular cam plate operatively interconnected to said motor for rotation thereby, said cam plate having a circular cam surface formed on one side thereof, said cam surface including at least one step in the shape thereof, a follower attached to said hammer and aligned to ride on said cam surface and spring means deployed between said hammer and said support plate for urging said hammer to an equilibrium position relative to said bell.

2. Apparatus according to claim 1 wherein:

said cam surface comprises at least one ramp projection extending a predetermined arcuate distance at a predetermined radius from the axis of said cam plate.

3. Apparatus according to claim 2 wherein:

said hammer comprises an elongate cylindrical rod mounted for sliding translation relative to said support plate along a radial path towards said bell, one end of said rod being aligned proximate said bell;

said annular cam plate is deployed around the other end of said rod transverse to the axis thereof; and said follower is secured to said other end of said rod.

4. Apparatus according to claim 3 wherein:

said rod and said spring means form an oscillatory spring mass system having a neutral state with said one end of said rod aligned in spaced relationship with said bell.

5. A bell assembly, comprising:

a bell adapted to produce acoustic energy on being subjected to impact; and a hammer assembly adjustably positionable relative to said bell including an elongate hammer mounted for sliding translation relative to said bell, spring means for maintaining said hammer in a neutral spaced alignment relative said bell, a rotary cam assembly having a helical cam surface terminating in a step, a follower connected to said hammer and operatively aligned to ride on said cam surface and motor means engaged to drive said cam assembly in rotation.

6. Apparatus according to claim 5 wherein:

said motor means is adjustable in the rotary rate thereof.

* * * * *